US006979178B2

(12) United States Patent
Chandraker

(10) Patent No.: US 6,979,178 B2
(45) Date of Patent: Dec. 27, 2005

(54) CYLINDRICAL BLADES FOR AXIAL STEAM TURBINES

(75) Inventor: Amrit Lal Chandraker, Hyderabad (IN)

(73) Assignee: Bharat Heavy Electricals Ltd., New Delhi (IN)

( * ) Notice: Subject to any disclaimer, the term of this patent is extended or adjusted under 35 U.S.C. 154(b) by 427 days.

(21) Appl. No.: 10/170,644

(22) Filed: Jun. 14, 2002

(65) Prior Publication Data

US 2003/0231961 A1 Dec. 18, 2003

(51) Int. Cl.[7] ..... F01D 5/14

(52) U.S. Cl. ..... 416/223 A; 416/DIG. 2; 416/DIG. 5

(58) Field of Search ..... 416/223 A, 243, 416/242, DIG. 2, DIG. 5

(56) References Cited

U.S. PATENT DOCUMENTS 5,352,092 A * 10/1994 Ferleger et al. ..... 416/223 A

* cited by examiner

*Primary Examiner*—Edward K. Look
*Assistant Examiner*—Dwayne J. White
(74) *Attorney, Agent, or Firm*—Venable LLP; Catherine M. Voorhees

(57) ABSTRACT

This invention relates an improved cylindrical blades for axial steam turbines comprising a leading edge and a trailing edge and a pressure face and a suction face and an inlet flow angle and an outflow flow angle at the leading edge and trailing edge respectively characterized in that the blades formed by setting angle variation for incompressible flow as well as at subsonic Mach numbers at the exit with a lower loss for a range of stagger angles.

5 Claims, 10 Drawing Sheets

Profile Geometry Definition

Fig. 1 Profile Geometry Definition
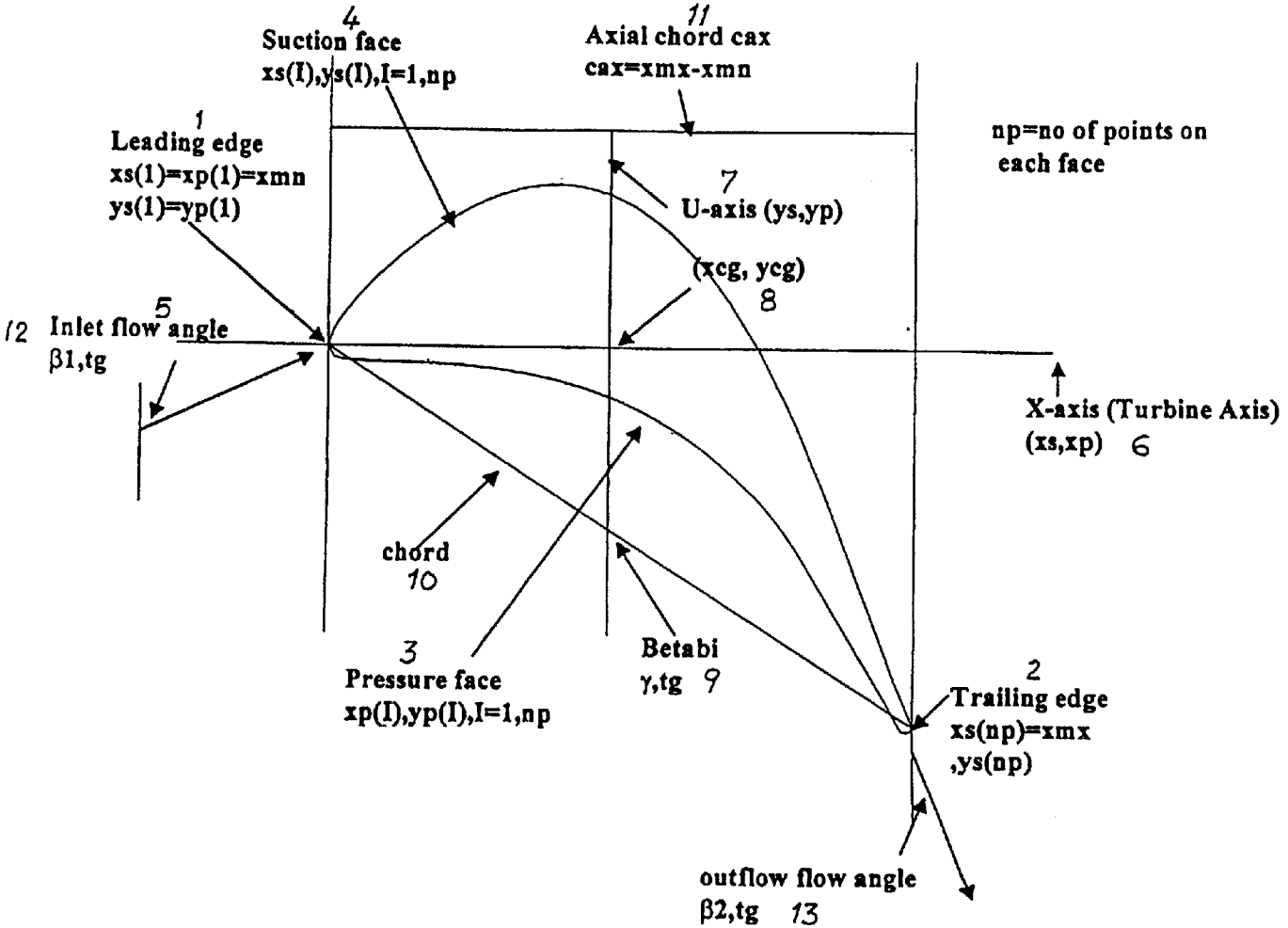

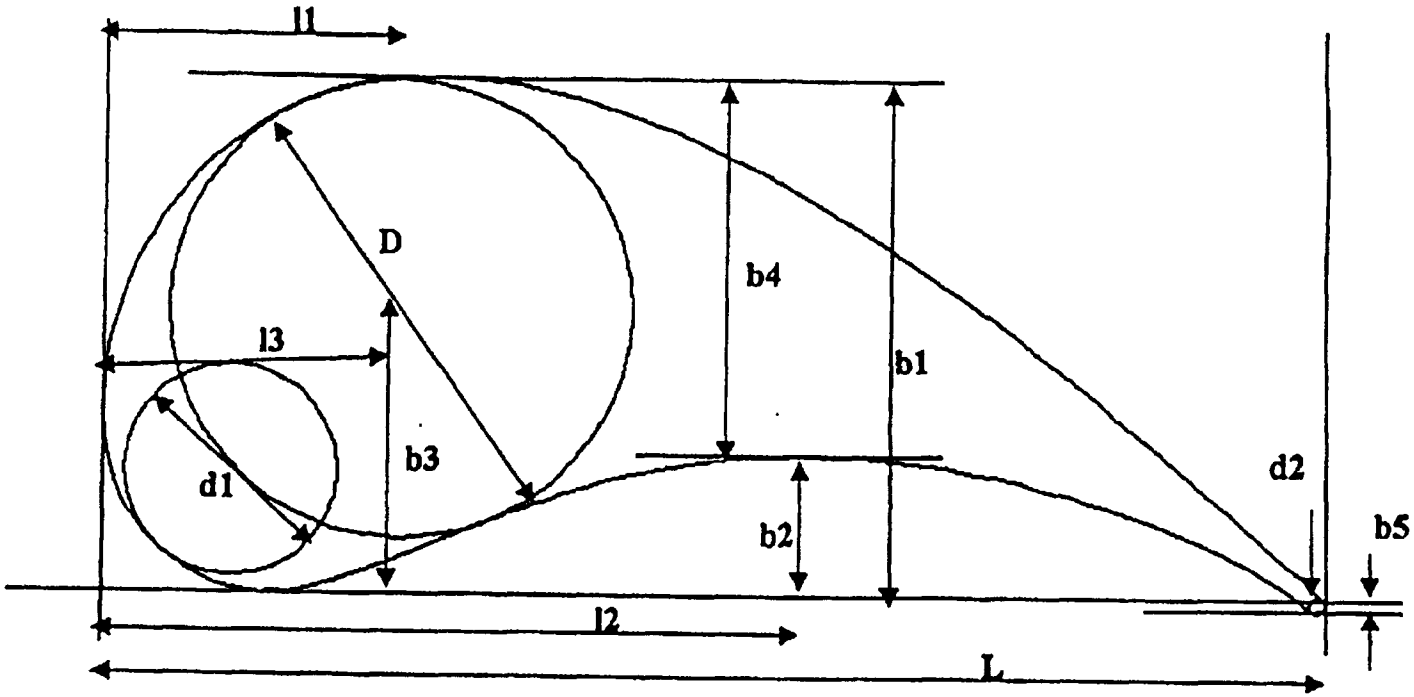
Fig. 2 Profile P3825 : Geometry Description

Profile P3825, Incompressible Case
Grid
$\gamma_{tg}$=57 deg, $\gamma_{tg}$=47 deg, Surface Pressure Distribution
at hub(squares)
at mean(triangles)
at tip(stars)
P VERSUS Z DISTANCE
P
Z DISTANCE

P VERSUS Z DISTANCE
P
Z DISTANCE

Profile P3825 Iso-Mach Contours

Incompressible $\gamma_{tg}$=57 deg $\gamma_{tg}$=47 deg

Note : Mach=0.05-.29(with increment of 0.03; corresponding to index 1,2,3,...

Compressible

Note : Mach=0.1-.9(with increment of 0.1; corresponding to index 1,2,3,...

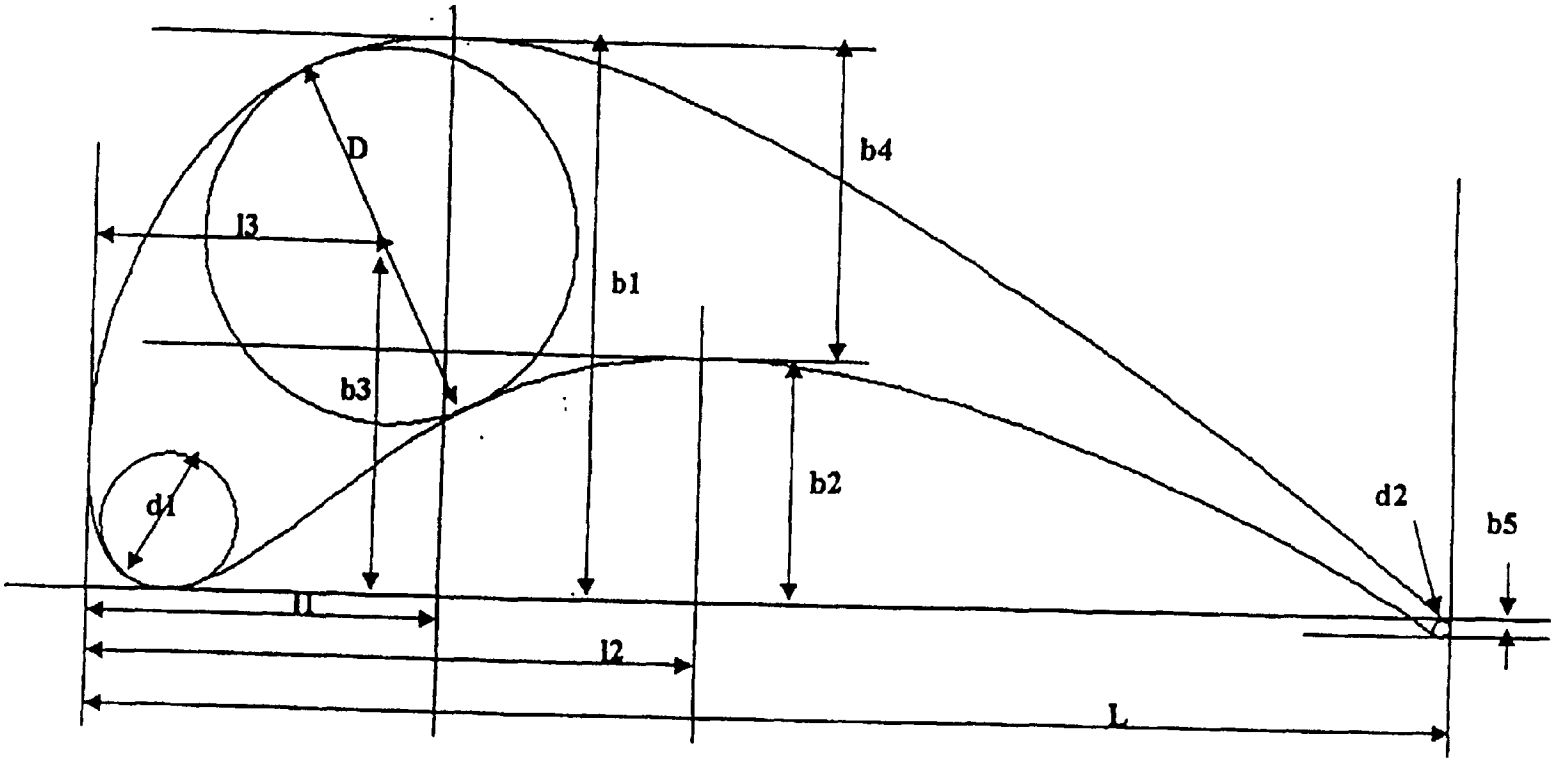
Fig. 5 Profile P2822 : Geometry Description

Profile P2822, Incompressible Case
Grid
Surface Pressure Distribution
at hub(squares)
at mean(triangles)
at tip(stars)
P VERSUS Z DISTANCE
P
Z DISTANCE
$\gamma_{tg}$=57 deg, $\gamma_{tg}$=47 deg,

Profile P2822 Iso-Mach Contours

Incompressible $\gamma_{tg}$=57 deg $\gamma_{tg}$=47 deg

Note : Mach=0.05-.29(with increment of 0.03; corresponding to index 1,2,3,...

Compressible

Note : Mach=0.1-.9(with increment of 0.1; corresponding to index 1,2,3,...

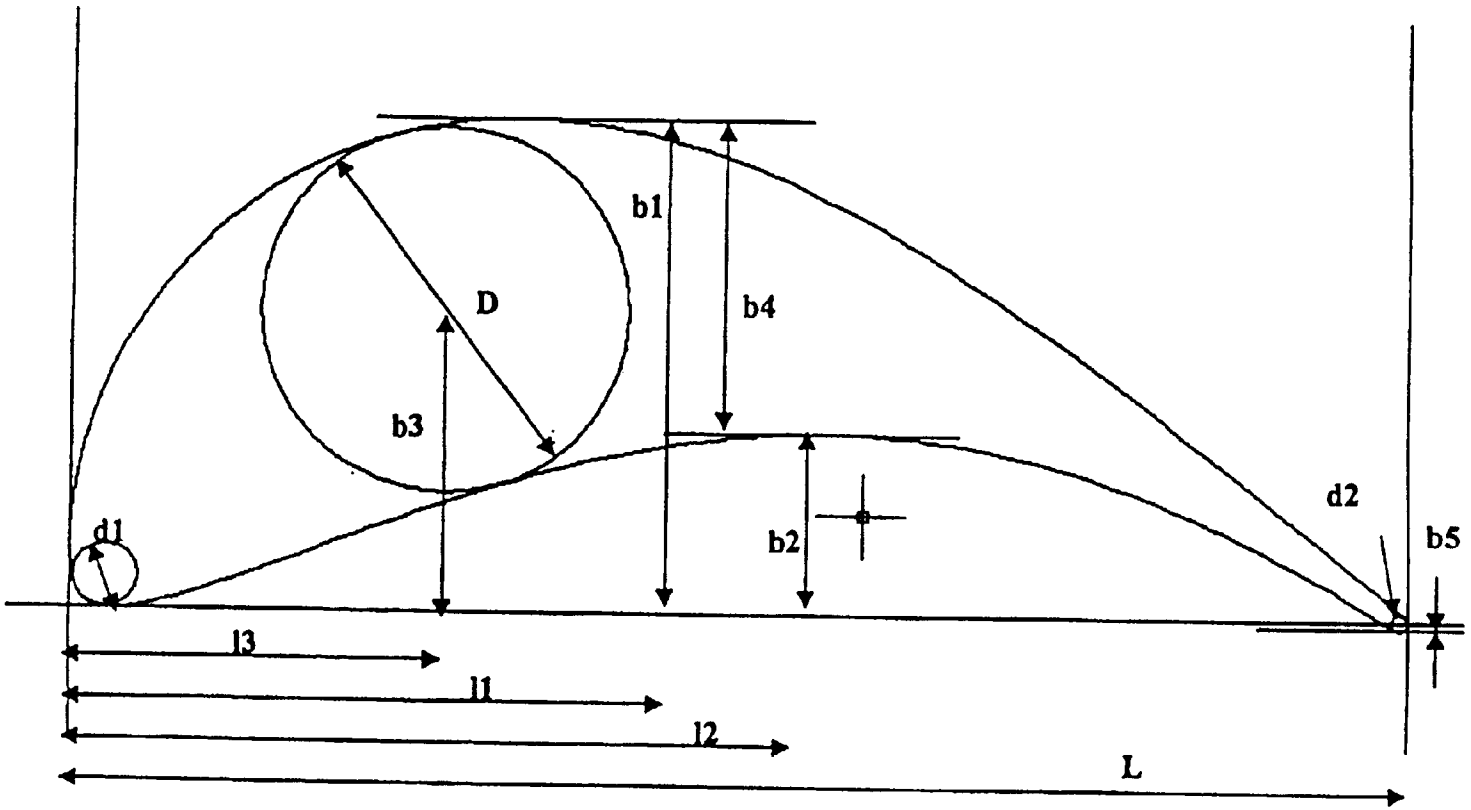
Fig. 8 Profile P2828 : Geometry Description

Profile P2828, Incompressible Case
Grid
$\gamma_{tg}$=57 deg, $\gamma_{tg}$=47 deg, Surface Pressure Distribution
at hub(squares)
at mean( triangles)
at tip(stars)
P VERSUS Z DISTANCE
Z DISTANCE

P VERSUS Z DISTANCE
Z DISTANCE

Profile P2828 Iso-Mach Contours

Incompressible $\gamma_{tg}$=57 deg $\gamma_{tg}$=47 deg

Note : Mach=0.05~.29(with increment of 0.03; corresponding to index 1,2,3,...

Compressible

Note : Mach=0.1~.9(with increment of 0.1; corresponding to index 1,2,3,...

CYLINDRICAL BLADES FOR AXIAL STEAM TURBINES

The present invention relates to an improved cylindrical blades for axial steam turbines and particularly to the aerodynamic improvement of straight, cylindrical blades, pertaining to high pressure, intermediate pressure and first few stages of low pressure cylinders of axial steam turbines.

BACKGROUND OF THE INVENTION

The efficiency of turbine is of paramount importance for cheaper power generation.

Two patents U.S. Pat. Nos. 5,211,703 (1993) and 5,192,190 (1993) on stationary blades are related to our field of invention.

The blades are considered to be most crucial apart from stationary flow path components for efficiency consideration. The improvement concerns to both stationary (guide and rotating moving) type of blades for axial steam turbines.

There are disadvantages associated with the present system of steam turbine blades.

The main disadvantage is that the turbine blades while converting heat energy into kinetic energy suffer two kinds of aerodynamic losses; one, the profile less due to streamwise boundary layer growth (along blade surfaces) and mixing in blade wakes, another due to secondary flow resulting from boundary layer growth along the hub and casing and flows resulting from turning of inlet boundary layer (passage vortex: pressure face to suction face in a cascade passage).

Steam turbine runner blades in high and intermediate pressure cylinders are of low height and low aspect; and most of the time one employs cylinder blades for energy transfer i.e. heat energy to kinetic energy.

Therefore the main object of the present invention of the improved cylindrical blades for axial steam turbines is to provide an improved blade profile for a wider stagger variation.

Another object of the present invention of improved cylindrical blades for axial steam turbines is to provide the blade suitable for a range of Mach numbers, incompressible to high subsonic flows.

According to the present invention there is provided improved cylindrical blades for axial steam turbines comprising a leading edge and a trailing edge and a pressure face and a suction face and an inlet flow angle and an outflow flow angle at the leading edge and trailing edge respectively characterized in that the blades formed by setting angle variation for incompressible flow as well as at subsonic Mach numbers at the exit with a lower loss for a range of stagger angles.

The nature of the invention, its objective and further advantages residing in the same will be apparent from the following description made with reference to the non-limiting exemplary embodiments of the invention represented in the accompanying drawings.

DESCRIPTION OF THE DRAWINGS

FIG. 1 shows the profile geometry of a turbine blade defining various features.

FIG. 2 shows the geometry description of the reference blade profile P3825.

FIG. 5 shows profile P2822 geometry description.

FIG. 8 shows the profile of the blade P2828 of the invention giving geometry description.

DETAIL DESCRIPTION OF THE INVENTION

Figures 3A, 3B, 3C, 3D:
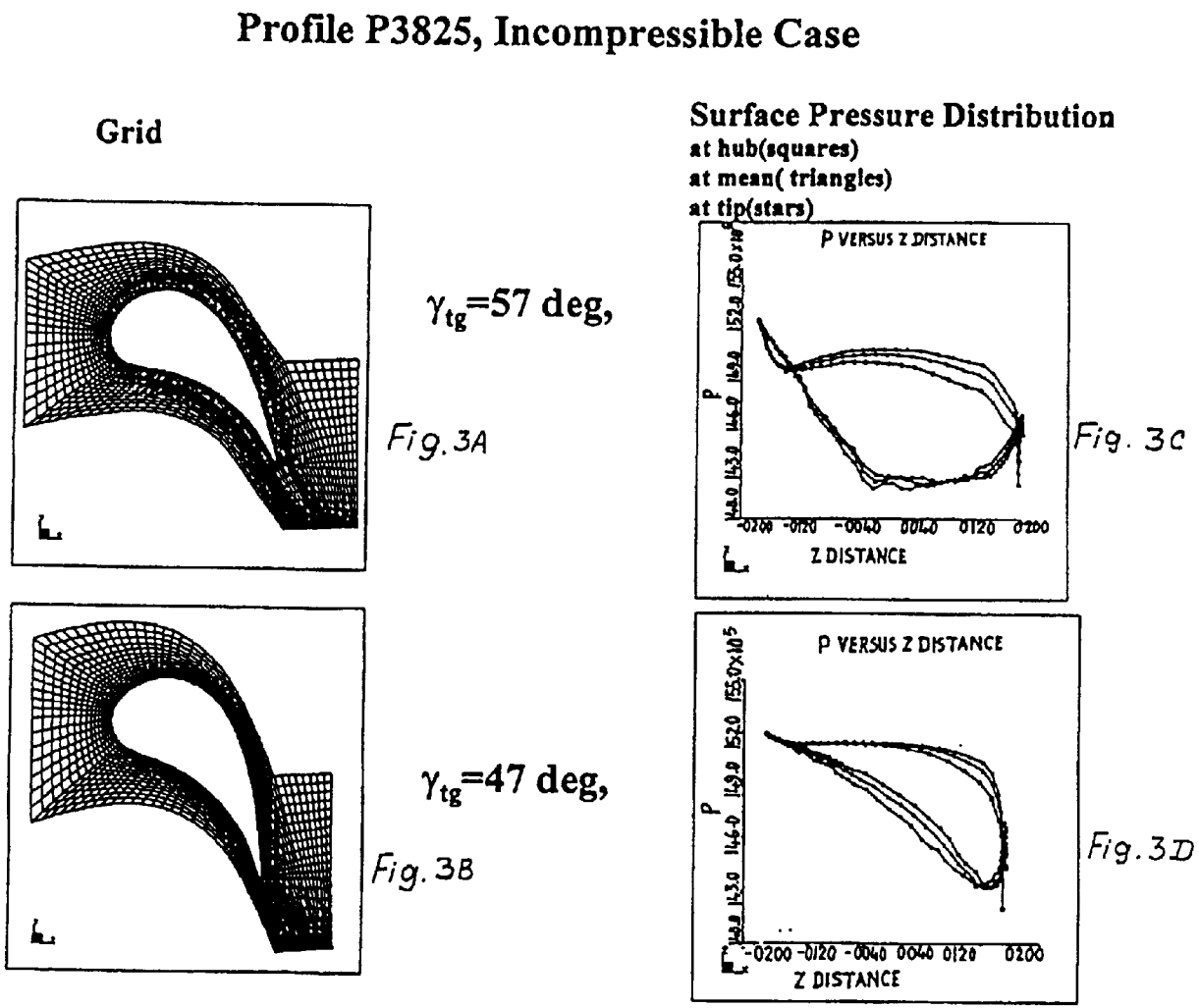
FIG. 3A shows grid profile at $_{tg}$=57 deg for profile P3825 incompressible case.
FIG. 3B shows grid profile at $_{tg}$=47 deg for profile P3825, incompressible case.
FIG. 3C shows surface pressure distribution for y, $_{tg}$=57 deg.
FIG. 3D shows surface pressure distribution for the y, $_{tg}$=47 deg.
Figure 4A:
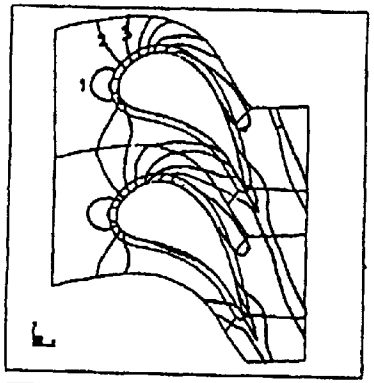
FIG. 4A shows profile P3825 ISO-Mach contours for incompressible y, $_{tg}$=57.
Figure 4B:
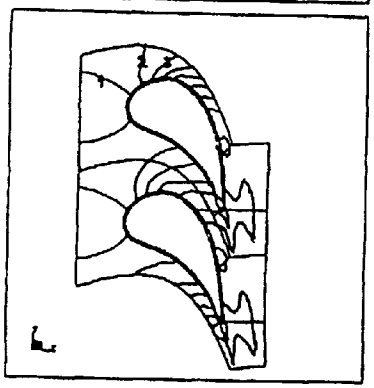
FIG. 4B shows ISO-Mach contours for incompressible y, $_{tg}$=47 deg.
Figure 4C:
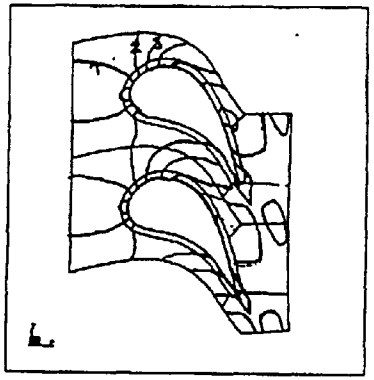
FIG. 4C shows ISO-Mach Contours for compressible and y, $_{tg}$=57 deg.
Figure 4D:
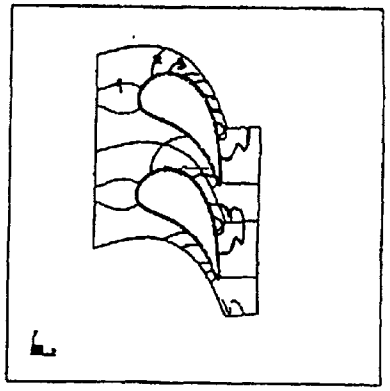
FIG. 4D shows ISO-Mach Contours for compressible and y, $_{tg}$=47 deg.

Turbine blades while converting heat energy into kinetic energy suffer two kinds of aerodynamic losses: one, the profile loss due to streamwise boundary layer growth (along blade surfaces) and mixing in blade wakes, another due to secondary flow resulting from boundary layer growth along the hub and casing and flows resulting from turning of inlet boundary layer (passage vortex: pressure face to suction face in a cascade passage. The reduction in losses is achieved by various means such as smooth surface and aft-loaded pressure distribution along the blade surfaces (instead of fore-loaded or flat-topped design). Smooth contour variation usually ensures lower profile losses for incompressible and subsonic flows. The lower velocity and cross-channel pressure gradient in the first part of cascade passage where the secondary flow originates; and higher diffusion in the rear part of suction face are the desired feature in aft-loaded profile which in turn reduces secondary flow losses.

Normally the cylindrical blade is of constant cross section and cylindrical in shape over the blade height. At any cross section the shape of the profile remains same as shown in FIG. 1. The profile or section is made of two surfaces: suction face (4) and pressure face (3), each joining leading edge (1) to trailing edge (2). X-axis (6) and y-axis (7) coincide to turbine axis and circumferential directions respectively.

Usually the centre of gravity lies at origin of co-ordinate axis (8). The blade or profile is set at angle 'betabi' or y, tg (9), also known as stagger or setting angle with respect to U-axis (7). Chord (12) is defined as profile length joining leading edge (1) (l.e) to trailing edge (te) (2). Axial chord (11) is the projected length of the profile on X-axis (6). Inlet and exit flow angles β1, tg (12) and β2, tg (13) are fluid flow angles with respect to tangent U-axis (7) respectively. The profile faces can be specified by various ways e.g. through discrete points (x, y co-ordinates), through a set of arcs and through bezier points. The basic difference between any two cylindrical blades is the profile shaped and at is being claimed here is the unique quantitative shape of the proposed blades.

The blades according to our invention has been developed using a unique set of bezier knots in such a manner that a pair of trailing edge portion while drawing trailing edge circle remains below base line (b5 is not zero as shown in FIGS. 2, 5 & 8).

The arrived profile configuration is then analysed with CFD solver and correction is made in the profile shape using new set of bezier points again in such a manner that a part of trailing edge portion remains below base line.

Steam turbine runner blades in high and intermediate pressure cylinders are of low height and low aspect, and most of time one employs cylindrical blades for energy transfer (heat to kinetic energy). An object of the present invention is to design improved blade profile for a wider stagger variation. Another objective of the invention is to provide the blade suitable for a range of Mach numbers (Incompressible to high subsonic flows). The invention brings out two different blade profiles (P2822 and P2828) with characteristics desired for lower energy losses for incompressible and subsonic regime. The profiles are somewhat aft-loaded. For the sake of comparison a centrally loaded profile is constructed and considered as reference profile.

The Reference Blade P3828

I. Geometry: FIG. 2 indicates a typical geometry P3825. The symbol P denotes profile and the number 3825 denotes the profile thickness value as 38% of chord located at 25% of chord distance from the leading edge. L denotes length of base chord. Diameters of leading edge circle, nearly largest incircle and trailing edge circle are denoted by d1, D and d2. The peak locations (maximum height) of suction and pressure faces are denoted by (11,b1) and (12,b2) respectively. The co-ordinates of centre of largest incircle is (13,b3) b4 is the difference (b1–b2). The vertical shift of lowest point at trailing edge (pressure face) from base line is denoted by b5.

II Performance Analysis: The proposed and reference blades are analysed by a common CFD (Computational Fluid Dynamics) software for identical flow conditions to simulate incompressible as well as subsonic flow regime. The profiles are examined for two extreme stagger angles y, tg=47 and 57 degrees to result outlet flow angles y2, tg variation of 10 degrees.

Annular stationary cascade performance of individual profiles is simulated by a CFD solver using superheated steam properties (in SI Units) and the ratio of specific heats k=1.3. Aspect ratio is around 2.2. Each of the blade is made of single profile for desired aspect ratio h/c. h and c are the blade height and chord, respectively. The blades are set at some stagger y, tg with usually optimum pitch-cord ratio s/c (s is the pitch). The stagger angle is acute angle between profile chord and circumferential direction. The incoming flow angle denoted by β1, tg; i.e. flow angle measured with respect to circumferential direction, is specified such that the flow enters nearly normal to the leading edge of the blade. The analysis resulted surface pressure distribution, spanwise axial exit velocity, isoMach contour within midspan cascade and relative effectiveness of the profile with reference to the reference blade.

Energy loss coefficient defined as $$\zeta=1-[1-p2/po2)^{k-1}/k]/[1-(p2/po1)^{k-1}/k]$$

where p2 is mass—averaged static pressure at the outlet; po1 and po2 are mass averaged stagnation pressure at the inlet and exit of the cascade. The effectiveness of a profile at midspan is defined as $$\xi=100^{+}(\zeta_{ref}-\zeta)/(1-\zeta_{ref})$$

where $\zeta_{ref}$ is energy loss coefficient of reference blade at desired y, tg and ζ is the loss coefficient of the profile being considered at the same setting y, tg. The positive and negative ξ means improvement and deterioration in performance respectively with reference to the reference profile.

FIG. 3 shows the mid-span grid and pressure variation on the profile surfaces at hub, midspan and tip for the settings y, tg=57 and 47 deg. The profile has flat topped pressure distribution over the pressure face. It is centrally loaded (pressure differential between pressure and suction face at constant axial location), apart from a flat region at the middle of suction fact for stagger=57 deg. The profile exhibits aft-loaded characteristics at the setting y, tg=47 deg. Iso-Mach contours for both setting angles are shown in FIG. 4. It shows downstream shift in Mach peak for setting y, tg=47 deg beside isocontour around trailing edge unaligned with exit flow direction, thus indicating more mixing loss downstream. More isocontours on the first part of suction face is concentrated in a small area in case of y, tg=57 compared to that of y, tg=47. Mach spikes due to round trailing edge (flow is unable to follow the contour) is visible. There is a change in shape of isocontour around trailing edge for high Mach number.

The Invented Blade P2822

I. Geometry: FIG. 5 indicates a typical profile geometry P2822. The symbol P denotes profile and the number 2822 denotes the thickness value as 28% of chord located at 22% of chord distance from the leading edge. Area is denoted above by te symbol A. The geometrical ratios are as follows (approximately to 3 or 4 digits after decimal):

D/L=0.277 d1/L=0.096 d2/L=0.014 A/(D*L)=0.612 b1/L=0.409 11/L=0.2615 b2/L=0.1795 12/L=0.452 b4/L=0.230 b3/L=0.2625 13/L=0.220 b5/L=0.014

Figures 6A, 6B, 6C, 6D:
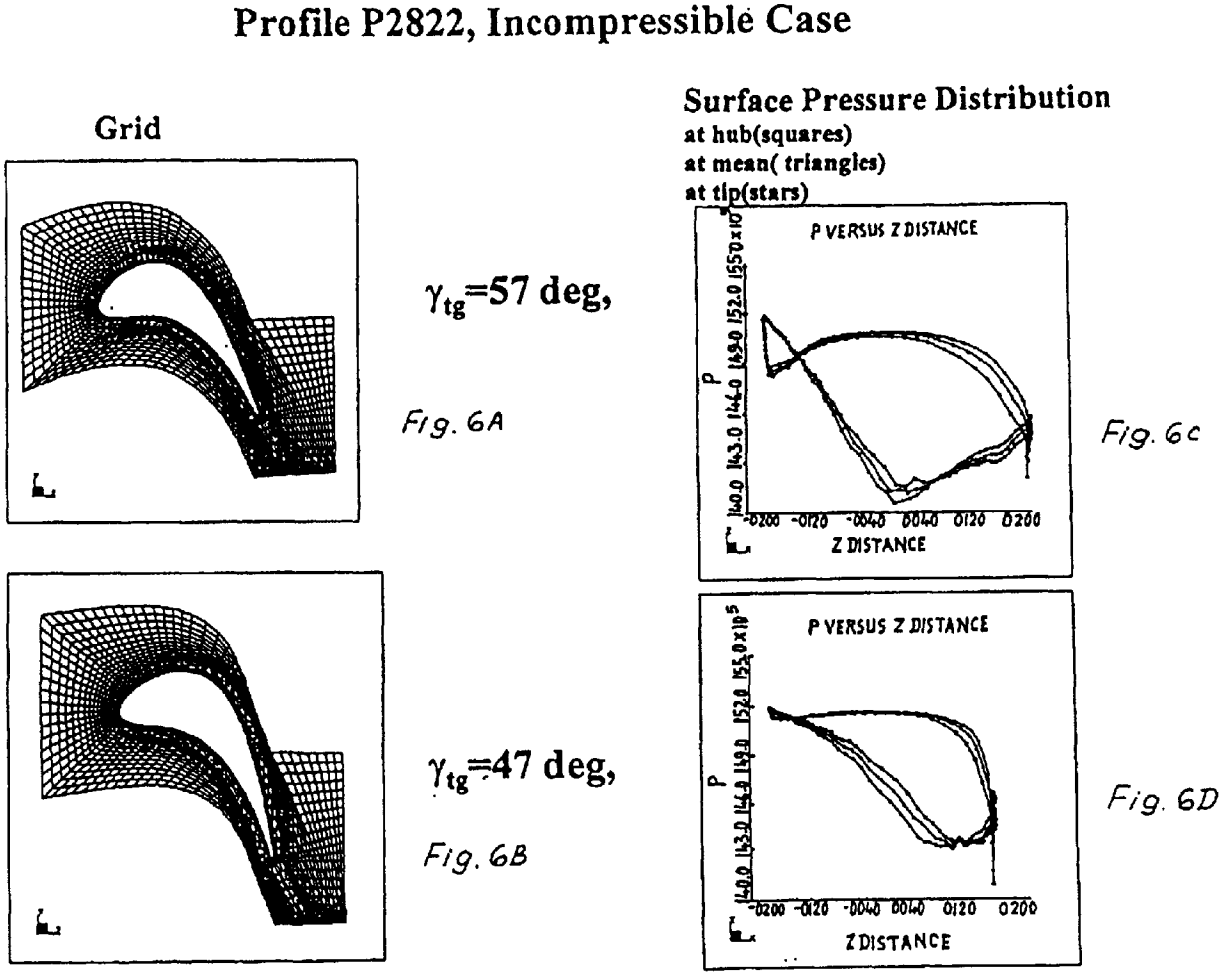
FIG. 6A shows profile grid of P2822 compressible case at y, $_{tg}$=57 deg.
FIG. 6B same as 6A with y, $_{tg}$=47 deg.
FIG. 6C shows surface pressure distribution of profile 2822 at y, $_{tg}$=57 deg.
FIG. 6D same as 6C with y, $_{tg}$=47 deg.
Figure 7A:
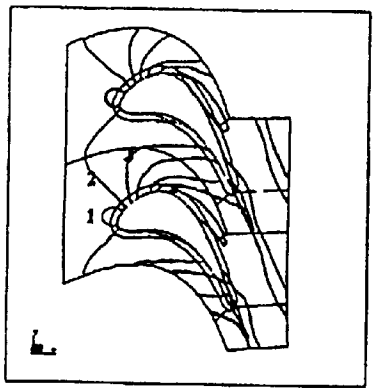
FIG. 7A shows profile P2822 ISO-Mach contours for in-compressible and y, $_{tg}$=57 deg.
Figure 7B:
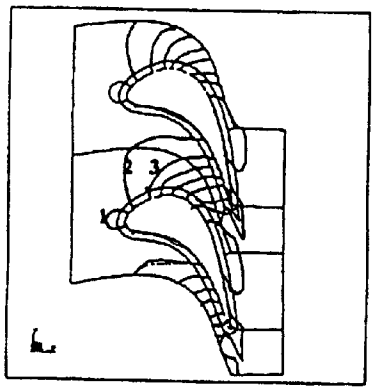
FIG. 7B same as 7A with y, $_{tg}$=47 deg.
Figure 7C:
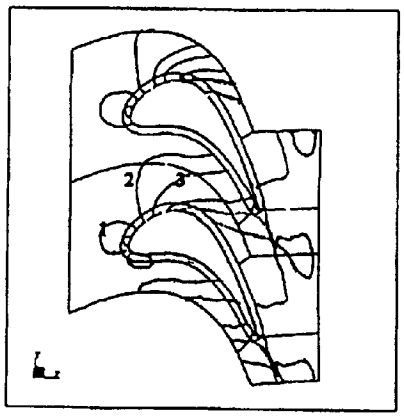
FIG. 7C shows profile of P2822 for compressible and y, $_{tg}$=57 deg.
Figure 7D:
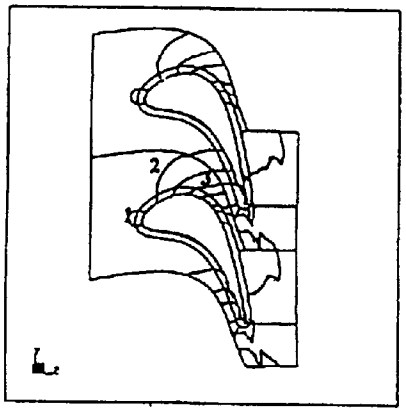
FIG. 7D same as 7C with y, $_{tg}$=47 deg.

Performance Analysis: The first proposed blades is analysed as discussed above. FIGS. 6–7 illustrate the computational grid, surface pressure distribution, isoMach contours FIGS. 6 for 57 deg stagger shows similarity in surface pressure distribution with profile P3825 but exhibits sharp diffusion at the centre of suction face. Local spikes at trailing edge due to round edge is visible. The effectiveness factor (ξ) with reference P3825 profile is 0.3 and 0.6% for stagger 57 and 47 degrees.

The corresponding figures at high Mach number are ξ=1.4 and 1.8% respectively. The isoMach contours are shown in FIG. 7 for 2 stagger angles and 2 exit Mach numbers. The first few iso contours are concentrated in a small length of inlet part of suction face. Highest M-peak and differential pressure loading are midway of the cascade in case of y, tg=57 compared to that of y, tg=47 where peak Mach number & $dM_{max}$ (=Maximum difference in Mach no. across from pressure to suction face) are at off the midway downstream. The profile P2822 thus behaves centrally loaded and high diffusion toward the exit (suction face) at high stagger and aft-loaded at low stagger. There is effectiveness increase due to Mach number effect, defined as ξ mach $$\xi_{Mach}=100*(\xi_{inc}-\xi)/(1-\xi_{inc})$$

where $\xi_{inc}$ is energy loss coefficient defined as earlier for incompressible flow.

There is increase in performance for high Mach no. ($\xi_{Mach}$=1.6 and 1.1% at stagger 57 and 47 degrees).

The Invented Blade P2828

I Geometry: FIG. 8 indicates another typical profile P2828. The symbol P denotes profile and the number 2828 denotes the profile thickness value as 28% of chord located at 28% of chord distance from the leading edge. The geometrical ratios are as follows (approximated to 3 digits):

D/L=0.279 d1/L=0.4049 d2/L=0.013 A/(D*L)=0.636 b1/L=0.377 11/L=336 b2/L=0.141 12/L=0.573 b4/L=0.236 b3/L=0.231 13/L=281 b5/L=0.006

Figures 9A, 9B, 9C, 9D:
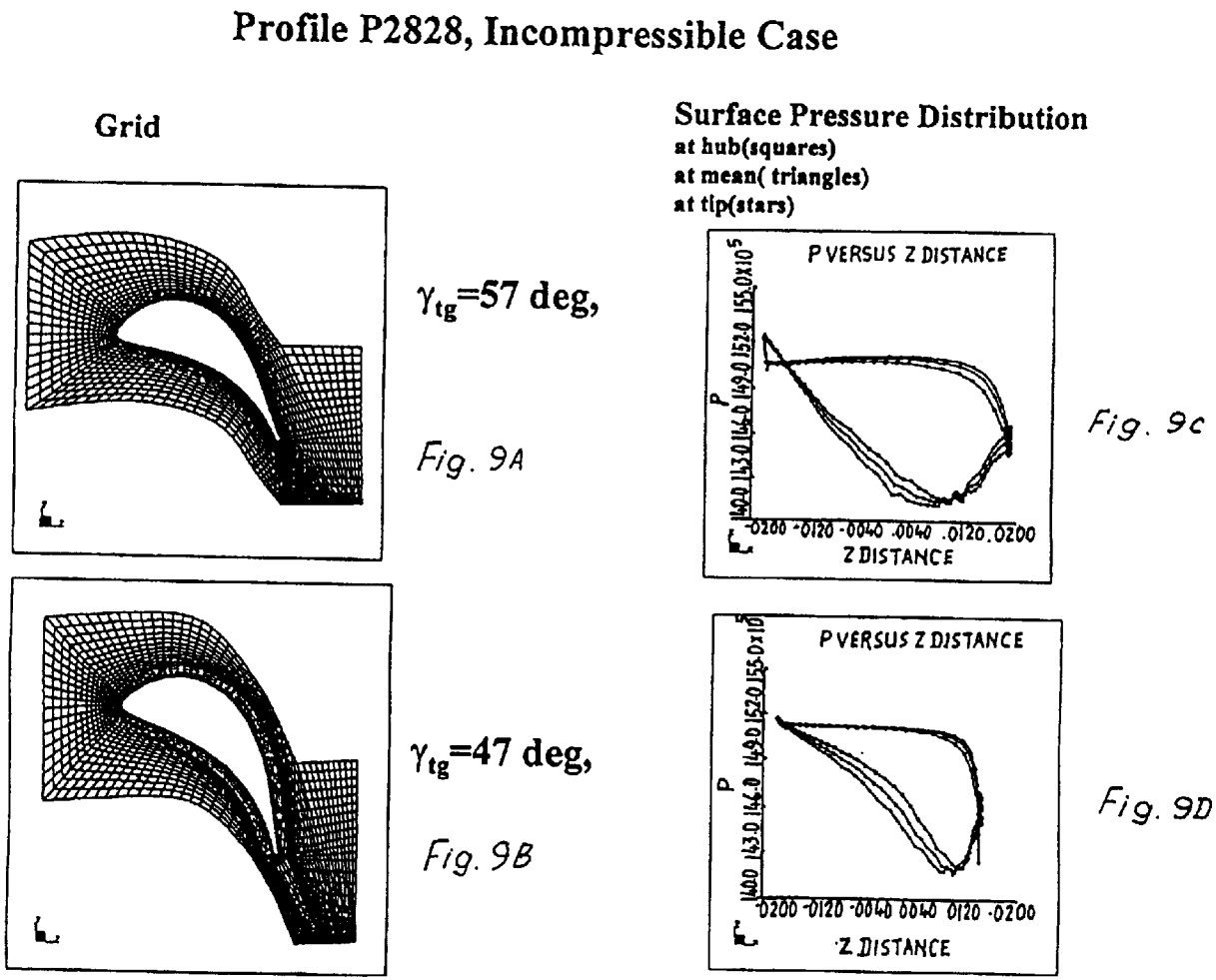
FIG. 9A shows grid profile P2828 incompressible case, at y, $_{tg}$=57 deg.
FIG. 9B same as 9A with y, $_{tg}$=47 deg.
FIG. 9C surface pressure distribution of profile P2828 incompressible case at y, $_{tg}$=57 deg.
FIG. 9D same as 9C with y, $_{tg}$=47 deg.
Figure 10A:
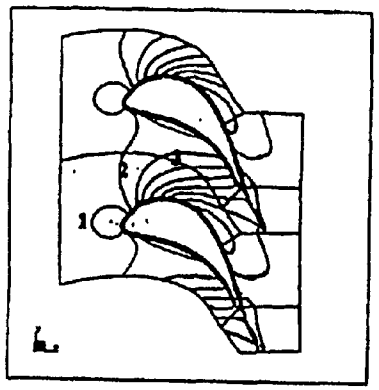
FIG. 10A shows profile P2828 ISO-Mach contour at y, $_{tg}$=57 deg. incompressible.
Figure 10B:
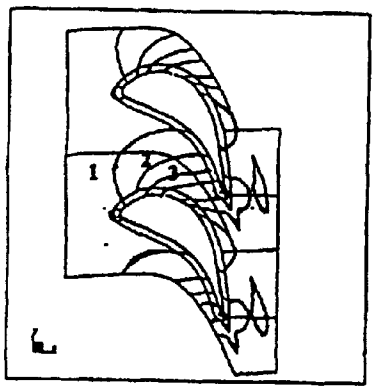
FIG. 10B shows same as 10A with y, $_{tg}$=47 deg.
Figure 10C:
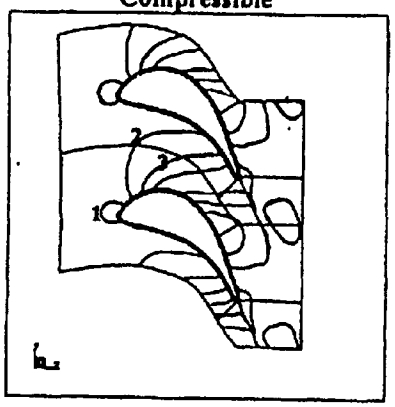
FIG. 10C same profile P2822 ISO-Mach contour at y, $_{tg}$=57 deg compressible.
Figure 10D:
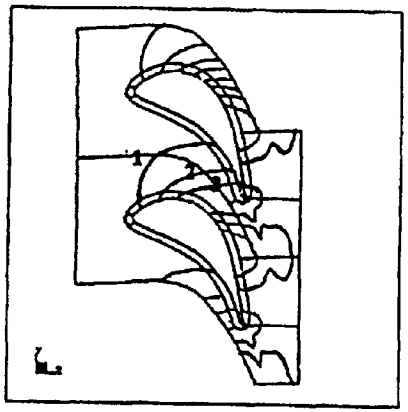
FIG. 10D shows same as 10C with y, $_{tg}$=47 deg.

Performance Analysis: The second proposed blades is analysed as discussed above FIGS. 9–10 illustrate the grid surface pressure distribution and isoMach contours. FIG. 9 shows aft-loadings at both staggers. Local spikes at trailing edge due to round edge is visible. The effectiveness factor (ξ) with reference to P3825 profile is 0.9 and 3%. The isoMach contours are shown in FIG. 10 for 2 staggers angles and 2 exit Mach numbers. The starting contours are concentrated in a small length of inlet part of suction fact. Peak Mach number & dMmax are at off the midway downstream. Mach number effect $\xi_{Mach}$ at high Mach no. is about 0.2 & −0.6% at stagger angle 57 and 47 degrees respectively.

The invention described hereinabove is in relation to a non-limiting embodiment as defined by the accompanying claims.

I claim:

1. Improved cylindrical blades for axial steam turbines comprising a leading edge and a trailing edge, a pressure face and suction face, and an inlet flow angle and an outflow angle at the leading edge and trailing edge respectively characterized in that the blades formed by setting angle variation in a range of 47–57 degrees for incompressible flows as and at a subsonic Mach number at <0.8 with a lower loss at a stagger angle of 57 degrees, wherein the blade or profile is set at an angle betabi or y, tg as stagger or setting angle with respect to U-axis and is defined as a profile length joining the leading edge to the trailing edge.

2. The improved cylindrical blades for axial steam turbines as claimed in claim 1 wherein the effectiveness factor (ξ) with reference to the reference profile is 0.3 and 0.6% for a stagger angle of 57 and 47 degrees (incompressible flow), ξ=1.4 and 1.8% for high Mach number (0.8).

3. The improved cylindrical blades for axial steam turbines as claimed in claim 1 wherein the profile thickness value as 28% of chord located at 22% of chord distance from the leading edge in geometrical ratios are D/L=0.277, d1/L=0.096 d2/L=0.014, A/(D*L)=0.612 b1/L=0.409, 11/L=0.2615 b2/L=0.1795 12/L=0.452, b4/L=0.230 b3/L=0.2625, 13/L=0.220 b5/L=0.014.

4. An improved cylindrical blade for axial steam turbines comprising a leading edge and a trailing edge, a pressure face and suction face, and an inlet flow angle and an outflow angle at the leading edge and trailing edge respectively characterized in that the blades formed by setting angle variation in a range of 47–57 degrees for incompressible flows as and at a subsonic Mach number at <0.8 with a lower loss at a stagger angle of 57 degrees wherein the profile thickness and its location are 28% and 22% of chord respectively, has the following geometrical ratios; and loss values:

D/L=0.279, d1/L=0.049, d2/L=0.013, A1(D*L)=0.636 b1/L=0.377, 11/L=0.336, b2/L=0.141, 12/L=0.573, b4/L=0.236 b3/L=0.231 13/L=0.281 b5/L=0.006

ξ=0.9 and 3.0% at y tg=57 and 47 degree respectively.

5. An improved cylindrical blade as per claim 1, wherein the profile thickness and its location are 28% and 22% of chord respectively, has the following geometrical ratios and loss values:

D/L=0.279, d1/L=0.049, d2/L=0.013, A1(D*L)=0.636 b1/L=0.377, 11/L=0.336, b2/L=0.141, 12/L=0.573, b4/L=0.236 b3/L=0.231 13L=0.281 b5/L=0.006

ξ=0.9 and 3.0% at y tg=57 and 47 degrees, respectively.

* * * * *

UNITED STATES PATENT AND TRADEMARK OFFICE

CERTIFICATE OF CORRECTION

PATENT NO. : 6,979,178 B2
APPLICATION NO. : 10/693945
DATED : December 27, 2005
INVENTOR(S) : Amrit Lal Chandraker It is certified that error appears in the above-identified patent and that said Letters Patent is hereby corrected as shown below:

Title page,
Insert Item -- [30] Foreign Application Priority Data
June 18, 2001 (IN) 676/Del/01 --.

Signed and Sealed this

Twentieth Day of June, 2006

JON W. DUDAS
*Director of the United States Patent and Trademark Office*

UNITED STATES PATENT AND TRADEMARK OFFICE

CERTIFICATE OF CORRECTION

PATENT NO. : 6,979,178 B2
APPLICATION NO. : 10/170644
DATED : December 27, 2005
INVENTOR(S) : Amrit Lal Chandraker It is certified that error appears in the above-identified patent and that said Letters Patent is hereby corrected as shown below:

Title page,
Insert Item -- [30] Foreign Application Priority Data
June 18, 2001 (IN) 676/Del/01 --.

This certificate supersedes Certificate of Correction issued June 20, 2006.

Signed and Sealed this

Twenty-fourth Day of October, 2006

JON W. DUDAS
*Director of the United States Patent and Trademark Office*